United States Patent [19]

Famiglietti et al.

[11] 4,025,146

[45] May 24, 1977

[54] ELECTRICAL CONNECTION DEVICES

[76] Inventors: Michele Famiglietti, Final del Puente 9 de Diciembre El Paraso; Raul Betancourt Sucre, Centro Villasmil, Piso 3, Oficina 303 Apartado No. 2842, both of Caracas, Venezuela

[22] Filed: Nov. 10, 1975

[21] Appl. No.: 630,244

[52] U.S. Cl. ..... 339/147 P; 337/197; 337/238

[51] Int. Cl.[2] ..... H01H 85/02; H01H 85/36

[58] Field of Search ..... 339/103 R, 103 M, 107, 339/147 R, 147 P; 337/197, 198, 238, 239

[56] References Cited

UNITED STATES PATENTS

| | | | |
|---|---|---|---|
| 2,668,885 | 2/1954 | Gerlat | 339/107 X |
| 2,808,485 | 10/1957 | Cardone | 337/198 |

*Primary Examiner*—Roy Lake
*Assistant Examiner*—E. F. Desmond
*Attorney, Agent, or Firm*—Ladas, Parry, Von Gehr, Goldsmith & Deschamps

[57] ABSTRACT

An electrical connection device comprises a body portion provided with female terminal elements and matching male terminal elements connected, respectively, to the corresponding female terminal elements. One of the male terminal elements is connected to the corresponding female terminal element by a fusible element located inside the body portion. In a variation, first and second body portions are provided with female and male terminal elements, respectively, and the corresponding terminal elements are connected together by the conductive cores of a flexible cord, the fusible element being located inside the second body portion.

1 Claim, 9 Drawing Figures

ELECTRICAL CONNECTION DEVICES

This invention relates to electrical connection devices.

Various safety devices used for preventing short circuits or overloads in electric lines are known. These devices include fuses, electromagnetic circuit breakers and more recently differential circuit breakers. Each of these devices is generally situated in a place not readily accessible or far from the site where the electric power is used. Moreover, it is generally difficult to locate the point where the damage originates, specially when multiple electric apparatus are used, since the safety systems mentioned cover a whole circuit or group of circuits and current interruption is produced in all the circuits involved. This is of course unnecessary and inconvenient.

According to one aspect of the present invention there is provided an electrical connection device, comprising a body portion provided with female terminal elements and matching male terminal elements connected, respectively, to the corresponding female terminal elements, one of the male terminal elements being connected to the corresponding female terminal element by a fusible element located inside said body portion.

According to another aspect of the present invention there is provided an electrical connection device, comprising a first body portion provided with female terminal elements, a second body portion provided with male terminal elements matching said female terminal elements, and a flexible cord having conductive cores which are connected at one end of the cord, within the first body portion, to the female terminal elements, respectively, and which are connected at the other end of the cord, within the second body portion, to the male terminal elements, respectively, matching the female terminal elements to which the cores are connected at said one end of the cord, and the device further comprising a fusible element connected between one of the terminal elements and that conductive core to which said one terminal element is connected, said fusible element being located within that body portion which is provided with said one terminal element.

The male terminal elements match the female terminal elements in the sense that if an electrical plug can be connected to an electrical socket through a device embodying the invention, by connecting the plug to the female terminal elements and inserting the male terminal element in the socket, the plug could be fitted directly in the socket without the interposition of the device embodying the invention.

The device according to the invention provides a means for supplementing and completing the normal safety measures in an electric circuit connected to the public electrical system. The device enables the intervention of the general circuit breaker system of the circuit to be avoided, and accordingly operation of the whole circuit is not affected in case of damage to a small part of the circuit. Moreover, the damage can be easily located since it is confined to the apparatus or equipment affected. An additional advantage of the device is that by virtue of the male terminal elements matching the female terminal elements the device is usable with any apparatus by simply inserting it between the latter and the electric supply line, this characteristic being therefore specially useful in equipments or apparatus that have no integral fuse of their own.

A device embodying the invention may be constructed to constitute an efficient preventive of short circuits that in many cases result in conflagrations of unforeseeable extent. On the other hand, as has been said before, the device may prevent the occurrence of blackouts in residences or installations by virtue of its characteristic localized fuse.

By using a device embodying the invention the damage caused in an apparatus may be confined to the apparatus itself and prevented from spreading to the supply line, with possibly serious consequences. Besides, due to the prompt reaction of the fusible element, the damage in the apparatus may be reduced to a minimum and major damage to the apparatus proper avoided.

For a better understanding of the invention and to show how the same may be carried into effect, reference will now be made, by way of example, to the accompanying drawings, in which.

Figure 1:
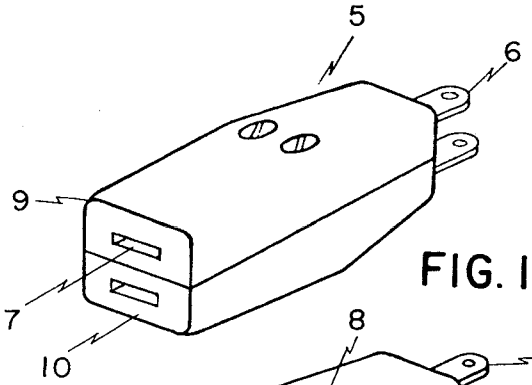
FIG. 1 shows a perspective view of a first embodiment of the invention.
Figure 2:
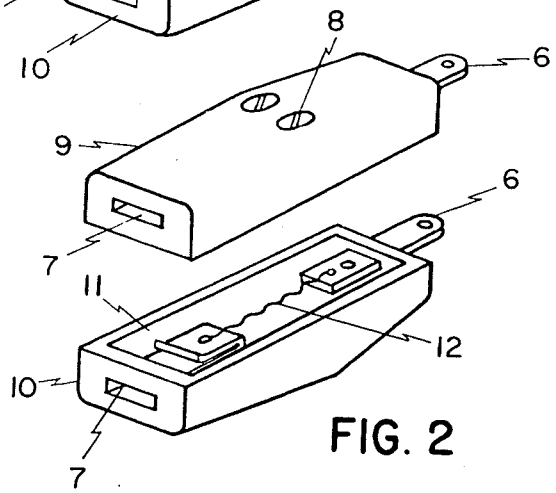
FIG. 2 shows a partially exploded perspective view of the device of FIG. 1.
Figure 3:
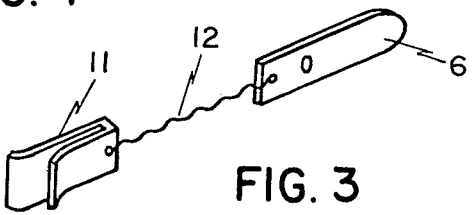
FIG. 3 shows some of the internal components of the device of FIG. 1.

The device shown in FIGS. 1, 2 and 3 comprises a body portion 5 made of two identical shells 9 and 10 which are coupled with each other by screws 8. The shells are formed with slots 7. Two male terminal elements 6 protrude through the two slots 7 at one end of the body portion 5, and two female terminal elements 11 are positioned inside the body portion 5 at the other end thereof so that they will engage with the terminals, inserted through the slots 7, of a plug connected to the device.

Each of the male terminal elements 6 is connected to the corresponding female terminal element 11 by a length of fusible wire 12. In this device, designed for household use, the fuse is dimensioned to bear a maximum current of 30 amperes with a potential of 110 volts, neutral phase.

Figure 4A:
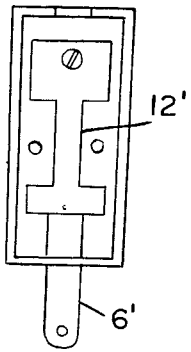
FIG. 4A shows a plan view of part of the second embodiment.
Figure 4:
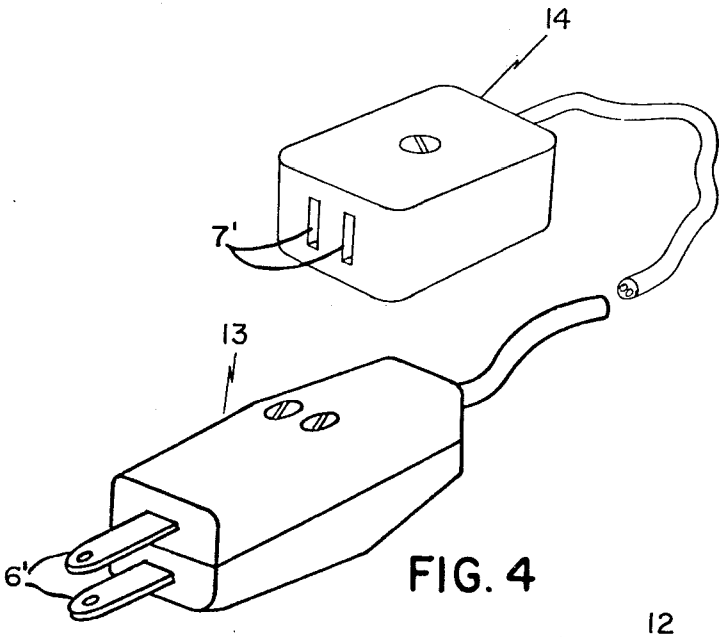
FIG. 4 shows a perspective view of a second embodiment of the invention.
Figure 6:
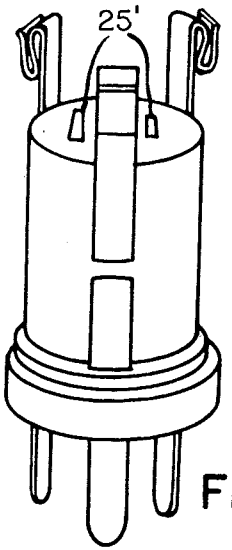
FIG. 6 shows a perspective view of one component of the third embodiment.
Figure 7:
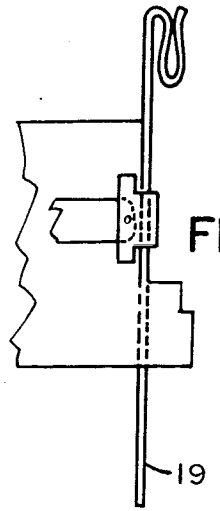
FIG. 7 shows an enlarged view of part of the component shown in FIG. 6.
Figure 8:
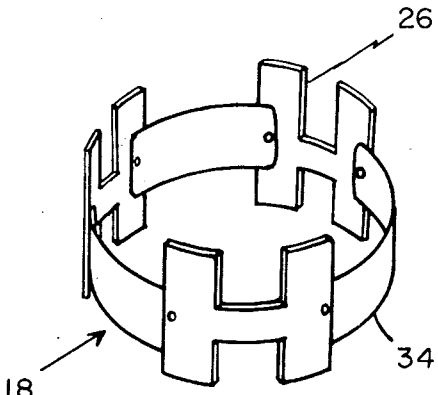
FIG. 8 shows an enlarged perspective view of a further part of the component shown in FIG. 6.
Figure 5:
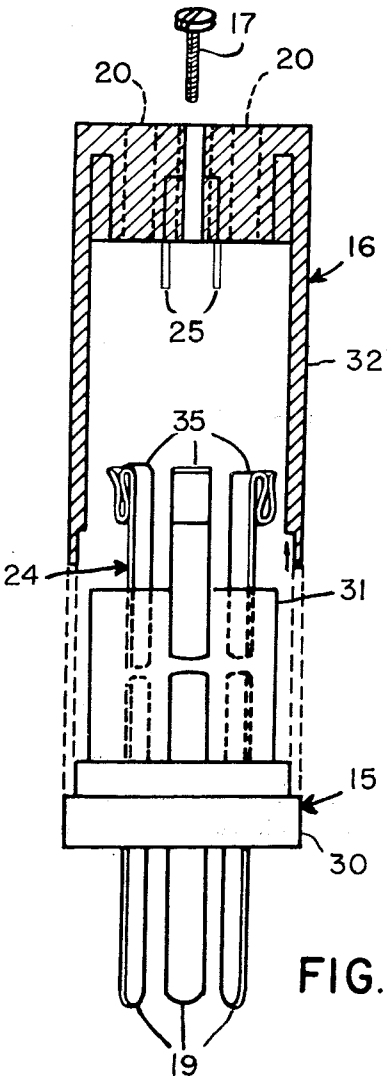
FIG. 5 shows a partially exploded, part sectional and part elevational, view of a third embodiment of the invention.

FIGS. 4 and 4A show a variant of the device with an extension cord. The device comprises two body portions 13 and 14 and a length of flexible cord having two conductive cores. The body portion 14 is formed with slots 7' and accommodates two female terminal elements (not shown) positioned so that they will engage with the terminals, inserted through the slots 7', of a plug connected to the device. The female terminal elements are connected, inside the body portion 14, with the two cores, respectively, of the flexible cord.

The body portion 13 is provided with two male terminal elements 6' which protrude through respective slots at one end of the body portion. The male terminal elements 6′ are connected, inside the body portion 13, with the two cores, respectively, of the flexible cord.

The body portion 13 contains two sheet form fusible elements 12′ whereby the conductive cores of the flexible cord are connected to the two male terminal elements 6′, respectively. As shown in FIG. 4, the body portion 13 comprises two shells, of which one is shown in FIG. 4A. At one end the shell if formed with a slot accommodating one end of the male terminal elements 6′, and the other end it is formed with a semicircular channel to enable the flexible cord to enter the body portion. The fusible element 12′ is mounted within the shell by virtue of its being secured at one end to the terminal element and secured at the other end by a terminal screw whereby one of the cores of the flexible cord is anchored within the shell.

FIGS. 5 to 8 show a variant of the device for use with a supply employing three conductors, for example, a 220 volt supply employing two phases and neutral or a three phase supply of higher voltage. The device comprises a carrier 15 and a cap 16, which can be secured together by a fastening screw 17.

The carrier 15 comprises a round base 30 and a coaxial cylindrical tower 31. The cap 16 comprises a tubular casing 32 which is closed at its upper end except for three slots 20 and a hole for the fastening screw 17. The tubular casing 32 fits coaxially over the cylindrical tower 31 and engages, at its open lower end, the round base 30 of the carrier 15. The cap 16 and the carrier 15 can be secured together by means of the screw 17, which threadedly engages a nut (not shown) fitted in the upper end of the cylindrical tower 31. The tower 25 carries two guide pins 25 of different widths insertable in corresponding slots 25′ in the tower 31 to ensure that the carrier 15 and the guide cap 16 are secured together by the screw 17 in the correct relative positions.

Three male terminal elements 19 extend through the round base 30 and about halfway along the exterior of the tower 31. Three female terminal elements 24 are aligned with the elements 19 and extend the rest of the way to the closed end of the casing 32, when the cap 16 and the carrier 15 are secured together by the screw 17. At their ends nearer the closed end of the casing 32, the female terminal elements have grip formations 35.

The elements 24 are slightly spaced along the tower 31 from the elements 19, but are connected electrically thereto by respective sheet fuses 26. The fuses 26 are joined together to form a fuse carrier ring 18 by elastic tapes 34 secured to the fuses by rivets. When the tapes 34 are unstressed, the diameter of the fuse carrier ring 18 is less than that of the tower 31; the tapes 34 have to be stretched in order to fit the carrier ring 18 on the tower 31 and this in turn ensures that the fuses 26 are held firmly against the elements 19 and 24.

The female terminal elements 24 match the male terminal elements 19, so that when the device is assembled and the three male terminal elements of a plug are inserted in the slots 20 respectively, the ends of the male terminal elements of the plug protrude into the interior of the casing 32 and engage and are gripped by the female terminal elements and accordingly electrical contact is established between the male elements of the plug and the male elements 19, through the fuses 26.

The device shown in FIGS. 5 to 8 is designed for industrial use, especially for those engines or machines which, because they are movable, have no fuse installations of their own. The device will be inserted between the electrical outlet socket and the engine's power plug, and upon occurrence of an abnormal increase of current intensity in any of the conductors, the corresponding fuse will melt. It is evident that when interruption occurs in any of the phases due to damage of any of the fuses, the interruption of the other phases will occur automatically by virtue of the linked relationship in which the fuses are arranged by means of the joining elastic tapes. Therefore the equipment becomes totally disconnected. The maximum length of each fuse is less than the distance between the elements 19 and 24 from phase to phase so that there will be no accidental connection established when the ring breaks.

It is to be understood that the invention is not limited to the specific construction shown and described, as it will be apparent to those skilled in the art that changes may be made without departing from the principles of the invention as defined in the appended claim.

We claim:

1. An electrical connection device, comprising a body portion provided with female terminal elements and matching male terminal elements connected to the corresponding female terminal elements by respective fusible elements located inside said body portion, said body portion being constituted by a circular base, a cylindrical cap which fits coaxially to the base, and a rod-form member secured coaxially to the circular base and extending coaxially within the cylindrical cap to define therewith a space of generally annular cross-section, and wherein the male terminal elements extend through said base and into said space while the female terminal elements extend within said space from the opposite end thereof from said base and are maintained in electrical contact with the male terminal elements by said fusible elements, said fusible elements being located in said space, each fusible elements being connected to at least one other fusible element by an elastic tape which is maintained under tension to urge the fusible elements into contact with the terminal elements.

* * * * *